US009709320B2

(12) United States Patent
Koo

(10) Patent No.: US 9,709,320 B2
(45) Date of Patent: Jul. 18, 2017

(54) FUNCTIONAL BEVERAGE MAKING AND DISPENSING FROM A REFRIGERATOR

(71) Applicant: Dongbu Daewoo Electronics Corporation, Seoul (KR)

(72) Inventor: Kwan Seo Koo, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 70 days.

(21) Appl. No.: 14/567,572

(22) Filed: Dec. 11, 2014

(65) Prior Publication Data

US 2016/0083241 A1 Mar. 24, 2016

(30) Foreign Application Priority Data

Sep. 23, 2014 (KR) ..... 10-2014-0126680

(51) Int. Cl.
*B67D 3/00* (2006.01)
*F25D 23/12* (2006.01)

(52) U.S. Cl.
CPC ..... *F25D 23/126* (2013.01)

(58) Field of Classification Search
CPC ..... B01F 15/0035; B01F 3/04808; B67D 3/0009; B67D 3/0012; B67D 3/0041; B67D 3/0058; F25D 23/126
See application file for complete search history.

(56) References Cited

U.S. PATENT DOCUMENTS 4,987,083 A * 1/1991 Apple ..... B67D 1/0016 141/105
5,178,799 A * 1/1993 Brown ..... B01F 3/04815 137/505.14
2010/0199705 A1* 8/2010 Crisp, III ..... B67D 1/0021 62/389
2011/0177201 A1* 7/2011 Sonnenrein ..... A23L 2/54 426/67
2013/0233180 A1* 9/2013 Belmont ..... A47J 31/407 99/323.2
2013/0273215 A1* 10/2013 Skalski ..... A47J 31/0668 426/115
2014/0199452 A1* 7/2014 Skalski ..... A47J 31/0668 426/431
2016/0083241 A1* 3/2016 Koo ..... B67D 3/0009 222/1

FOREIGN PATENT DOCUMENTS

KR 1020110021253 A 3/2011
KR 1020110098419 A 9/2011
KR 1020140108092 A 9/2014

* cited by examiner

*Primary Examiner* — Frederick C Nicolas
*Assistant Examiner* — Bob Zadeh

(57) ABSTRACT

A refrigerator capable of dispensing functional beverages. A user can request a functional beverage and specifies the desired concentration via an input unit on the refrigerator. The refrigerator includes a solute supplying unit storing the solute for making the functional beverage and a dissolution chamber. The solute mixes with water into the user-selected functional beverage in the dissolution chamber. The amount of solute introduced to the dissolution chamber is controlled based on the user desired concentration. The produced functional beverage is then dispensed for user to consume.

4 Claims, 8 Drawing Sheets

FUNCTIONAL BEVERAGE MAKING AND DISPENSING FROM A REFRIGERATOR

CROSS-REFERENCE TO RELATED APPLICATIONS

This application claims benefit and priority from Korean Patent Application No. 10-2014-0126680, filed on Sep. 23, 2014 with the Korean Intellectual Property Office, the disclosure of which is incorporated herein in its entirety by reference.

TECHNICAL FIELD

The present disclosure relates to a refrigerator and an operation method thereof, and more particularly, to water dispensing mechanisms of a refrigerator.

BACKGROUND

Typically, a refrigerator includes a main body having a storeroom, such as a freezer or a cool chamber, a freezing apparatus in the main body for generating cold air, and a door to the storeroom.

FIGS. 1A and 1B are diagrams illustrating a refrigerator equipped with a water dispenser according to the prior art.

As illustrated in FIG. 1A, the refrigerator may include a purified water dispenser tap 25 and a cold water dispenser tap 26.

As illustrated in FIG. 1B, water discharged from the water supplying valve 11 passes through a water purifying filter 12 and then is stored in the water container 13. Water is supplied to the dispenser 27, positioned higher than the water container, 13 under the force of the booster pump 16.

The purified water may be directly dispensed to the outside of the refrigerator for consumptions, or frozen or cooled by an ice making device or a cooling device 22 before being dispensed as ice.

There is a trend that various additional functionalities are being demanded by consumers related to water/ice dispensing.

SUMMARY

Provided herein is a refrigerator capable of making and dispensing a functional beverage, e.g., oxygen water or carbonated water, at a variable concentration responsive to user input.

An exemplary embodiment of the present disclosure provides a refrigerator, including: a dissolution chamber configured for the solute to mix with water into a functional beverage; a compressed gas container supplying the gas solute to the dissolution chamber; a discharge valve located between the compressed gas container and the dissolution chamber; and a gas supply unit including the compressed gas container and the discharge valve.

Another exemplary embodiment of the present disclosure provides an operation method of a refrigerator, including: supplying water to a storing chamber; supplying the stored water to a dissolution chamber; determining whether a functional beverage is selected; supplying gas solute from a gas supplying unit to the dissolution chamber when the functional beverage is selected; and discharging the resultant functional beverage through a dispenser.

Yet another exemplary embodiment of the present disclosure provides a refrigerator, including: a storing chamber configured to store water; a first compressed gas container configured to store first gas solute; a first gas supplying unit including a first discharge valve for discharging the first gas solute from the first compressed gas container; a second compressed gas container configured to store second gas; a second gas supplying unit including a second discharge valve for discharging the second gas from the second compressed gas container; and one or more dissolution chambers configured to receive water from the storing chamber, and dissolve the gas solute discharged from one or more of the first gas supplying unit and the second gas supplying unit in the received water.

Still another exemplary embodiment of the present disclosure provides an operation method of using a refrigerator, including: receiving, by an input unit, a selection of both a kind of functional beverage and a concentration of the functional beverage, and generating a signal; then opening, by a controller, a discharge valve corresponding to the selected functional beverage according to the signal for an opening time proportional to the selected concentration, and discharging gas solute from a compressed gas container to a dissolution chamber; and discharging, by a dispenser, the functional beverage made by the gas discharged to the dissolution chamber from the dissolution chamber.

According to the exemplary embodiments of the present disclosure, a user can advantageously and conveniently obtain a functional beverage in a preferred concentration from a refrigerator.

This summary contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION

Figure 1A:
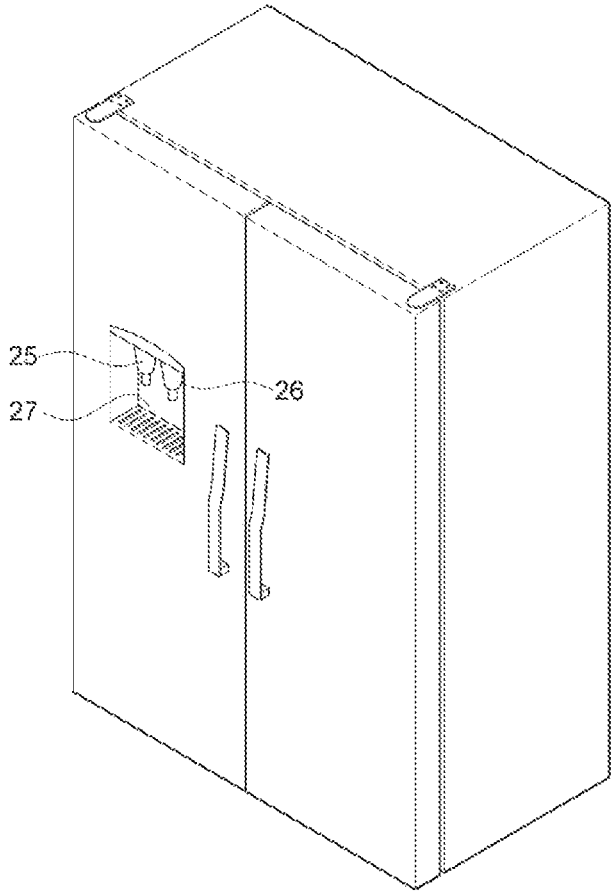
Fig.1A (Prior Art)
FIGS. 1A and 1B are diagrams illustrating an example of a refrigerator including a dispenser according to the prior art.
Figure 1B:
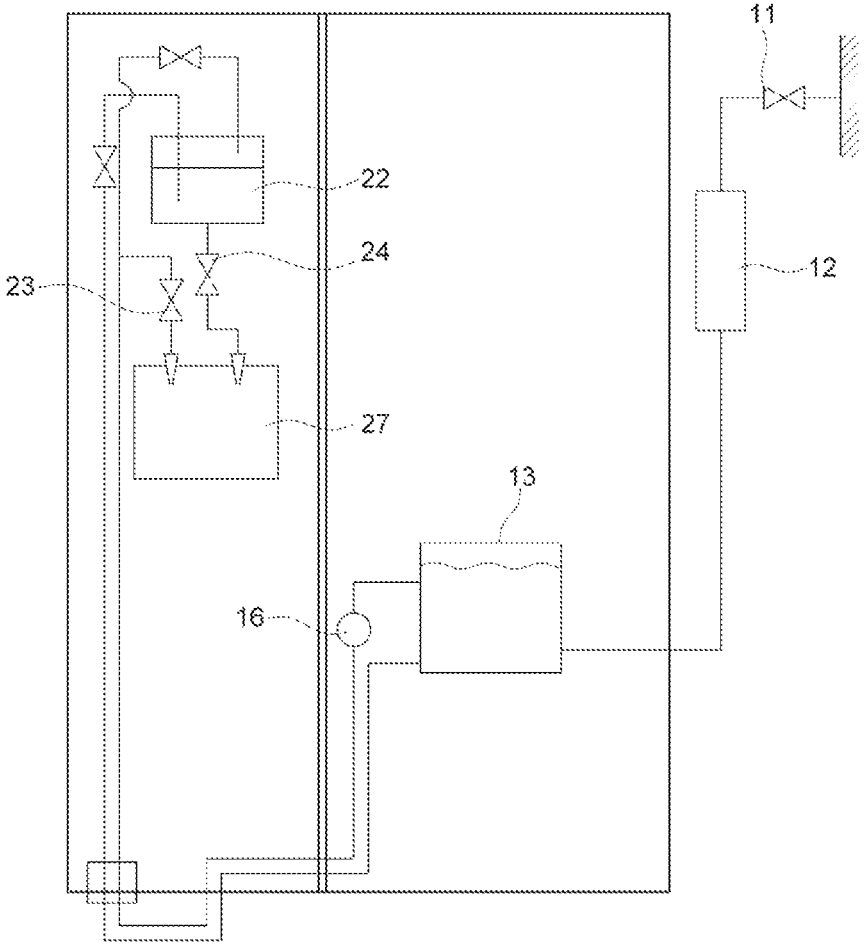
Fig.1B (Prior Art)

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment according to the present disclosure will be described in detail with reference the accompanying drawing. A configuration of the present disclosure and an operational effect according to the configuration of the present disclosure will be clearly understood by the detailed description below. In the following description, the same elements will be designated by the same reference numerals as far as possible although they are shown in different drawings, and a detailed explanation of known related functions and constitutions may be omitted when it is determined that the detailed explanation obscures the subject matter of the present disclosure.

First Exemplary Embodiment

Figure 2:
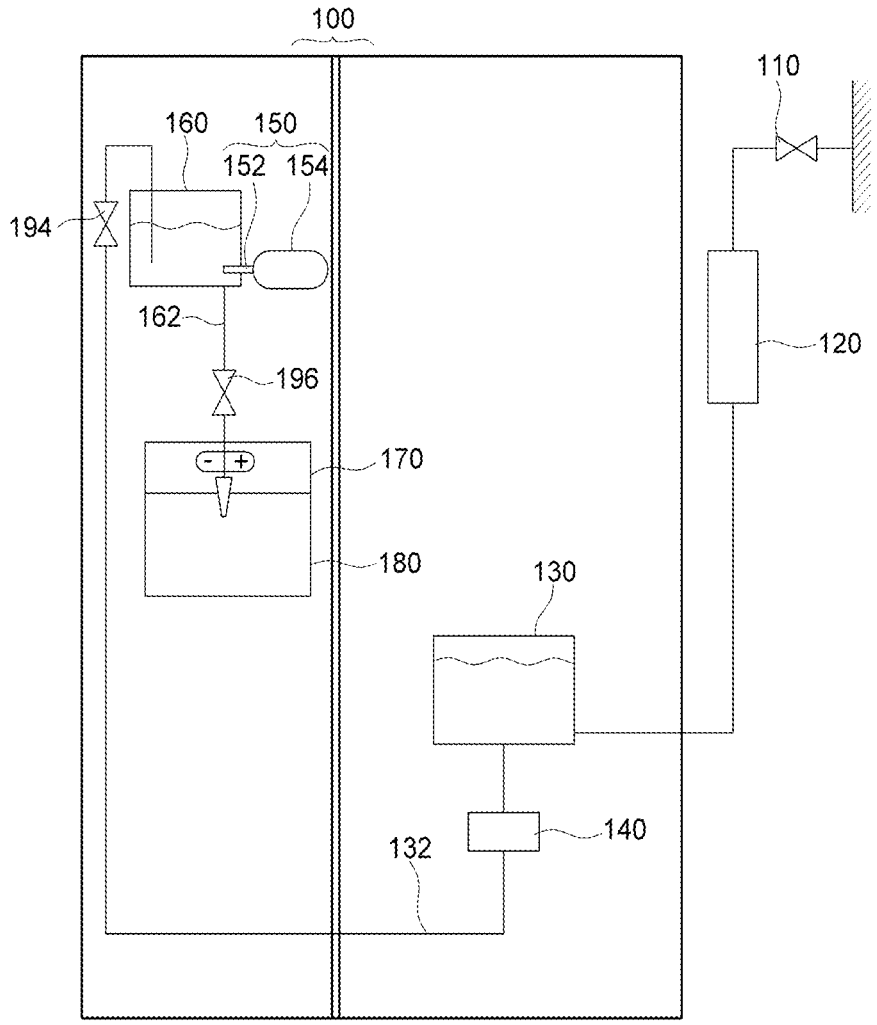
FIG. 2 is a front view of an exemplary refrigerator according to an embodiment of the present disclosure.

FIG. 2 is a front view of an exemplary refrigerator according to an embodiment of the present disclosure.

Figure 3:
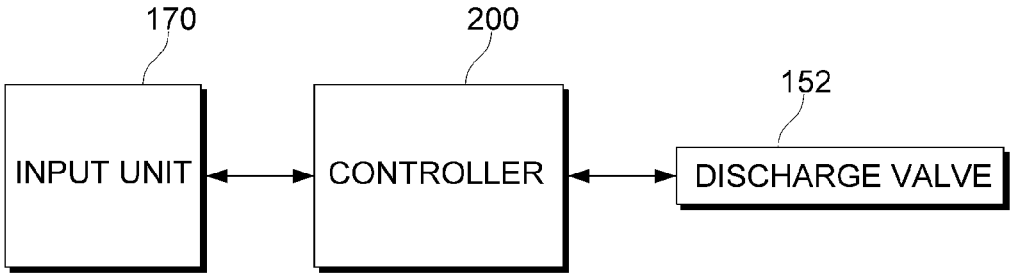
FIG. 3 is a functional configuration diagram of an exemplary refrigerator according to the embodiment of the present disclosure.

FIG. 3 is a functional configuration diagram of the exemplary refrigerator according to an embodiment of the present disclosure.

Referring to FIGS. 2 and 3, refrigerator 100 according to embodiments the present disclosure includes a water storing chamber 130 for storing water, a compressed gas container 150 for storing compressed gas used as solutes for making functional water, and a dissolution chamber 160 for mixing water and the gaseous or liquid solute into functional or flavored beverage (hereinafter "functional water" or "functional beverage").

The functional water produced in the dissolution chamber 160 is discharged through a dispenser 180 disposed on the exterior housing of the refrigerator.

The storing chamber 130 serves to store water provided from a water supply. According to a user selection received on the input unit 170, the water stored in the storing chamber 130 is either discharged directly through the dispenser 180 or provided to the dissolution chamber 160 and made into functional water.

The input unit 170 may be installed on the front side of the refrigerator and allows a user to select choices from cold water, purified water, and functional water for dispensing.

The input unit 170 generates a signal indicative of the user selected water type and sends the signal to the controller 200.

In another embodiment, the input unit 170 may be integrated with a display unit, e.g., a touch panel.

The compressed gas container 150 stores gaseous or liquid solutes used for making the functional water.

The dissolution chamber 160 is used for mixing the water supplied from the storing chamber 130 with the solute supplied from the compressed gas container 150 to produce functional water.

A discharge valve 152 is coupled to the dissolution chamber 160 and controls the flow of gas in the compressed gas container 150 to be introduced to the dissolution chamber 160.

When a user requests to dispense functional water, the input unit 170 may allow the user to select a desired concentration level as well. The input unit 170 can generate a signal including the concentration information.

The display unit can display the selection options such as selected level of concentration, the amount of functional water made and the like.

The controller 200 controls the discharge valve 152 in accordance with the selected level of the concentration. The controller 200 can control the concentration by controlling the amount of the gaseous solute discharged from the compressed gas container 150 to the dissolution chamber 160. For instance, the controller 200 may control the opening time and opening size of the discharge valve 152 when it releases the solute to the dissolution chamber 160.

The storing chamber 130 and the dissolution chamber 160 may be coupled to a water purifying pipe 132. A valve 194 may be further provided and located between the dissolution chamber 160 and the purified water pipe 132.

The dissolution chamber 160 and the dispenser 180 are coupled through a water purifying pipe 162. A valve 196 is used between the dissolution chamber 160 and the dispenser 180. The valve 196 is usually closed to prevent water from flowing backward, except when water is being dispensed.

The dispenser 180 discharges the water stored in the storing chamber 130 or the functional water stored in the dissolution chamber 160 through a water supplying valve. A water supplying pump 140 is disposed between the storing chamber 130 and the dissolution chamber 160.

After the functional water in the dissolution chamber 160 is discharged through the dispenser 180, the water supplying pump 140 refills water into the dissolution chamber 160 from the storing chamber 130.

The water supplied through a water supplying valve 110 may be purified or filtered through a water purifying filter 120 and then stored in the storing chamber 130.

The present disclosure is not limited to any specific ingredient, solute or flavor used for making functional water. Also, the gaseous solute may be oxygen, carbon dioxide, or the like. When using oxygen, oxygen water is produced; and when using carbon dioxide, carbonated water is produced in the dissolution chamber.

With the aforementioned configuration, water is supplied from an external water supply source and stored in the dissolution chamber 160. Based on user input via the input unit 170, the controller 200 controls the discharge valve 152 to introduce an appropriate amount of the solute from the compressed gas container 150 to the dissolution chamber 160, thereby controlling the concentration of the functional water. The functional water made in the dissolution chamber 160 is discharged through the dispenser 180 via the water supplying valve 194.

Figure 4:
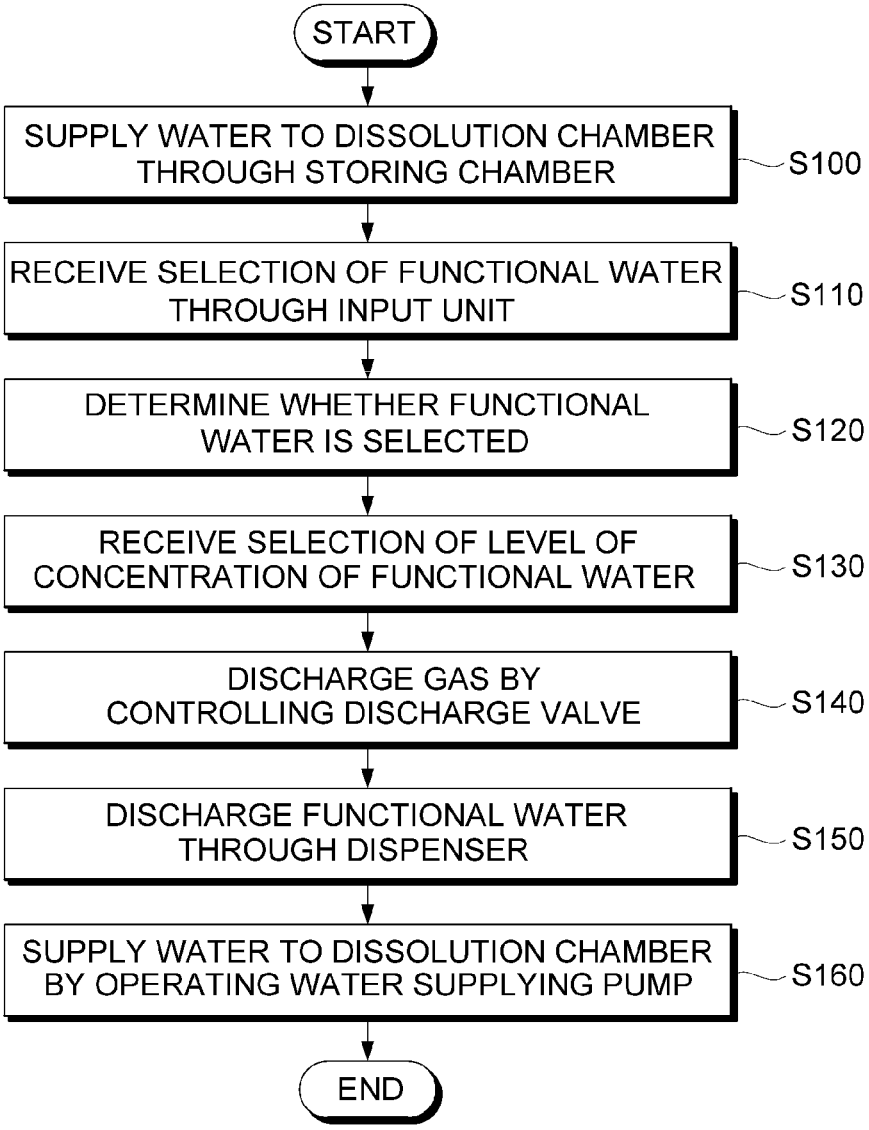
FIG. 4 is a flowchart describing an exemplary process of providing functional water form the refrigerator according to an embodiment of the present disclosure.

FIG. 4 is a flowchart describing an exemplary method of making and providing functional beverages by the refrigerator according to the exemplary embodiment of the present disclosure. One or more steps may be computer controlled.

Water is supplied to the storing chamber 130 and then to the dissolution chamber 160 and used as a base for making functional water (S100).

When a type of functional water is selected by a user, the input unit 170 generates a signal indicating that the functional water option is selected by a user (5110). The signal is sent to the controller 200 (S120).

Next, the input unit 170 receives a user selection on the level of concentration of the selected functional water (S130), and generates a corresponding signal which is sent to the controller 200 (S130). In response, the controller 200 controls the discharge valve 152 to release a certain amount of the gaseous solute from the compressed gas container 150 to the dissolution chamber 160 (S140) in accordance with the user selected level of concentration. In another embodiment, liquid solute may be stored and used for making the functional water.

The controller 200, e.g., a processor or computer, may adjust the concentration of the functional water by controlling the opening time and opening size of the discharge valve 152 and thereby controlling the amount of solute released to the dissolution chamber.

Once a user requests for functional water, the controller 200 supplies the gas solute from the gas supply unit 150 to the dissolution chamber 160. The gas solute is dissolved in water in the dissolution chamber 160, and thereby the functional water is produced. The functional water is then dispensed to the user through the dispenser (S150).

When the functional water made in the dissolution chamber is discharged by the dispenser 180, the controller 200 controls the water supplying pump to resupply water from the storing chamber 130 to the dissolution chamber 160 (S160).

Second Exemplary Embodiment

Figure 5:
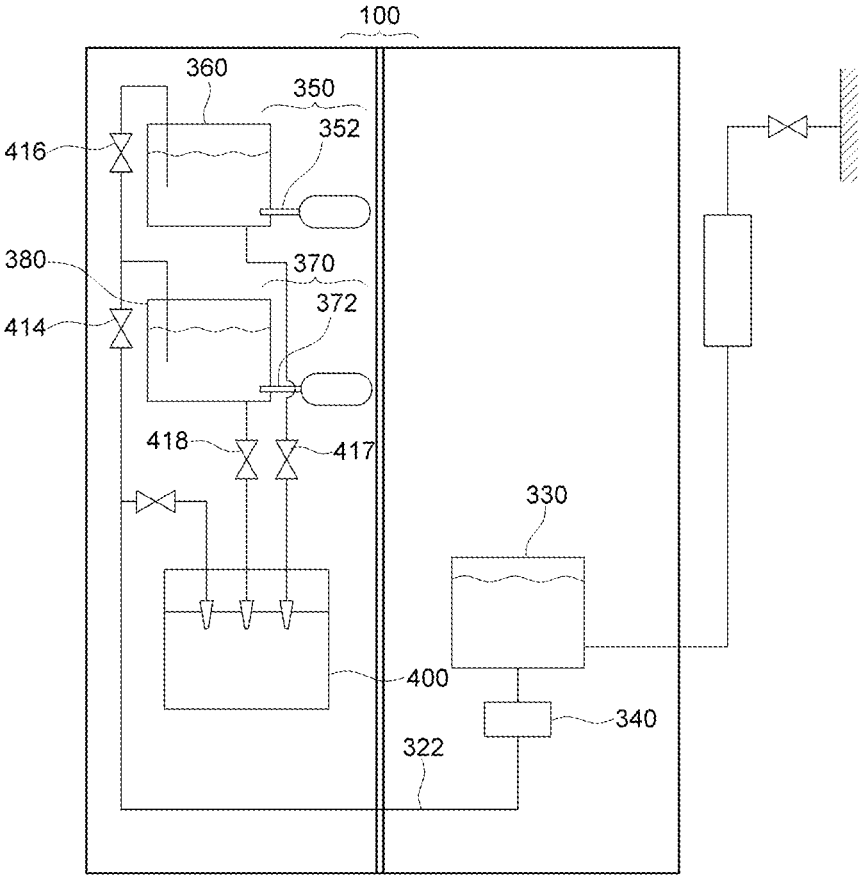
FIG. 5 is a front view of an exemplary refrigerator according to another embodiment of the present disclosure.

FIG. 5 is a front view of an exemplary refrigerator according to another embodiment of the present disclosure.

Figure 7:
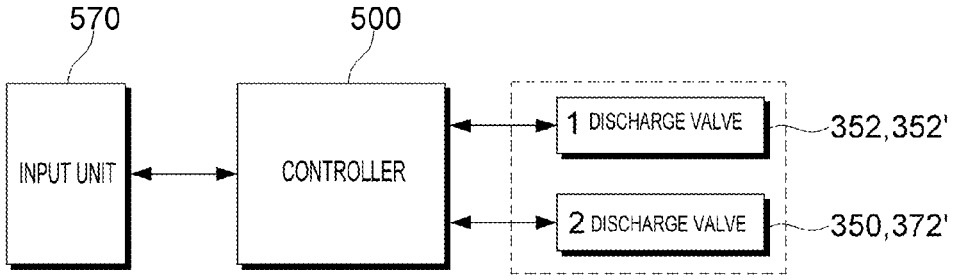
FIG. 7 is a functional configuration diagram of an exemplary refrigerator according to another embodiment of the present disclosure.

FIG. 7 is a functional configuration diagram of an exemplary refrigerator according to an embodiment of the present disclosure.

A refrigerator capable of providing two or more kinds of functional water according to another exemplary embodiment of the present disclosure will be described with reference to FIGS. 5 and 7. In the illustrated example, only two kinds of functional beverages can be supplied from the refrigerator, but the present disclosure is not limited thereto.

Refrigerator 100 includes a water storing chamber 330 for supplying water, compressed gas containers 350 and 370 for storing respective solutes of the functional water, and dissolution chambers 360 and 380 for mixing the a solute with water to make functional water. The functional water made in the dissolution chambers 360 and 380 is discharged through a dispenser 400 disposed on the exterior housing of the refrigerator.

The storing chamber 330 stores water provided from a water supply via a water pipe. According to a user selection via an input unit 570, water stored in the storing chamber 330 can be discharged through the dispenser 400 directly or provided to the dissolution chambers 360 and 380 and used for making functional water.

The input unit 570 is disposed on the front of the refrigerator, and allows a user to select choices such as cold water, purified water, or functional water. The input unit 570 generates a signal based on the user selection and sends the signal to the controller.

The compressed gas container 350 stores the first type of solute (or the "first solute") used for making the first functional water. The compressed gas container 370 stores the second type of solute (or the "second solute") used for making the second functional water. Each of the first solute and second solute can be in a gas or liquid form.

The first dissolution chamber 360 is used for the first solute to mix with water to make the first functional water. The second dissolution chamber 380 is used for the second solute to mix with water to produce the second functional water.

The first discharge valve 352 is located between the first compressed gas container 350 and the first dissolution chamber 360, and controls the first solute to be released from the first compressed gas container 350 to the first dissolution chamber 360.

The second discharge valve 372 is located between the second compressed gas container 370 and the second dissolution chamber 380, and controls the second solute to be released from the second compressed gas container 370 to the second dissolution chamber 380.

The input unit allows a user to select a functional water kind as well as the desired concentration level thereof. The input unit 570 may generate a signal indicating the selected concentration level.

A display unit may display the selected choice of functional water and/or the selected level of the concentration, the amount of functional water made, and the like.

The controller 500 can interpret the signals from the input unit 570 and accordingly control the discharge valves 352 and 372 to introduce the appropriate solute in the appropriate amount to the dissolution chamber. The controller 500 can control the opening time and/or opening size of the corresponding discharging valve 352 or 372 in accordance with the selected level of the concentration.

That is, the controller 500, e.g., computer, may control the amount of gas solute discharged from the compressed gas container to the dissolution chamber by selecting any one of the first discharge valve 352 and the second discharge valve 372 according to the kind of functional water selected through the input unit 570 by the user. The controller can further control the opening time of the selected discharge valve or the diameter of the opening in accordance with the user-selected level of the concentration of the functional water.

The storing chamber 330 and the dissolution chambers 360 and 380 are coupled to each other through the water purifying pipe 332. The first valve 416 is disposed between the storing chamber 330 and the first dissolution chamber 360. The second valve 414 is disposed between the storing chamber 330 and the second dissolution chamber 380.

The water supplying pump 340 is disposed between the storing chamber 330 and the dissolution chambers 360 and 380.

Once the functional water is discharged from one of the dissolution chambers 360 or 380 to the dispenser 400, the water supplying pump 340 operates to resupply water from the storing chamber 330 to the dissolution chamber.

In this example, the first gaseous solute and the second gaseous solute are oxygen and carbon dioxide, respectively. Therefore, the refrigerator can dispense both oxygen water and carbonated water at a user's choice.

With the aforementioned configuration, water supplied from an external water supply source is stored in the dissolution chambers 360 and 380 via the water supplying valves 414 and 416. The controller 200 controls the opening time and/or opening size of discharge valve 152 to ensure the functional water has the user-desired concentration. The gas or liquid solute in the compressed gas container 350 or 370 is released to the dissolution chambers 360 or 380 under the control of the controller. The functional water made in the dissolution chambers 360 or 380 is discharged through the dispenser 400 via the water supplying valves 417 or 418.

Figure 8:
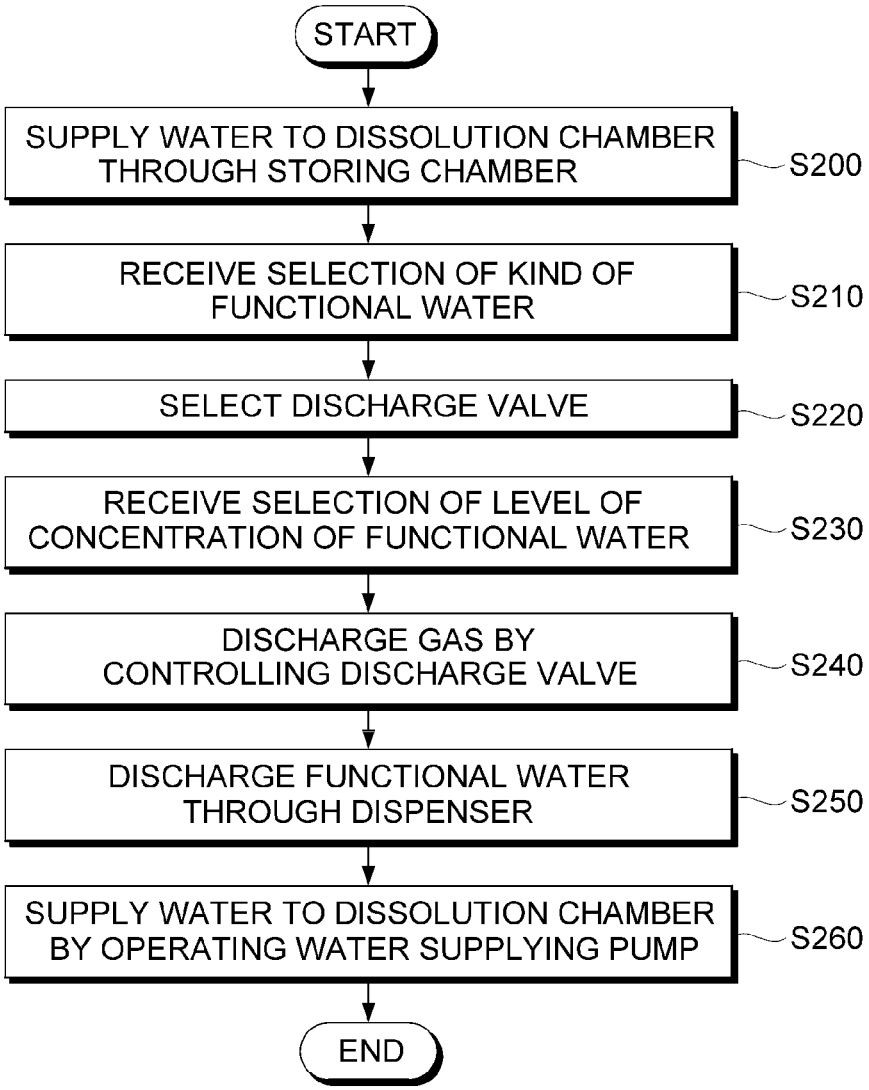
FIG. 8 is a flowchart describing an exemplary process of providing functional water from the refrigerator according to another embodiment of the present disclosure.

FIG. 8 is a flowchart depicting an exemplary process of the refrigerator according to a second embodiment of the present disclosure. One or more steps may be computer controlled.

Water is supplied to the storing chamber 330 and then to the dissolution chambers as the base or solvent for dissolving the solutes and thereby making functional beverages (S200).

When a user selects a choice of functional water, the input unit 570 generates a first signal indicating the selected choice (S210), and sends the signal to the controller 500. In response, the controller 500 identifies the corresponding discharge valve 352 or 372 to release the needed solute (S220).

The input unit 570 receives a user selection on the level of concentration of the functional water (S230), and correspondingly generates a second signal to send to the controller 500. The controller 500 verifies that the level of concentration is selected based on the second signal.

Responsive to the first and the second signals, the controller 500 causes a certain amount of the selected gas solute to be introduced to the corresponding dissolution chamber (S240). It will be appreciated that solute may be stored in a gas or liquid form. In this example, the controller 500 may control the concentration of the functional water by controlling the opening time and size of the discharge valve when the solute is being introduced to the dissolution chamber.

For example, when the user selects the first functional water through the input unit 570, the controller 500 determines the amount of first solute needed and controls the first discharge valve 352 to discharge the determined amount of first solute to the first dissolution chamber 360. In the first dissolution chamber, the first solute dissolves in water pre-stored therein, thereby producing the first functional water. The produced functional water is discharged through the dispenser (S250).

Once the functional water made in the dissolution chamber is discharged via the dispenser 400 in S250, the controller 200 controls water supplying pump 340 to resupply the water from the storing chamber 130 to the dissolution chamber 160 (S260).

Third Exemplary Embodiment

Figure 6:
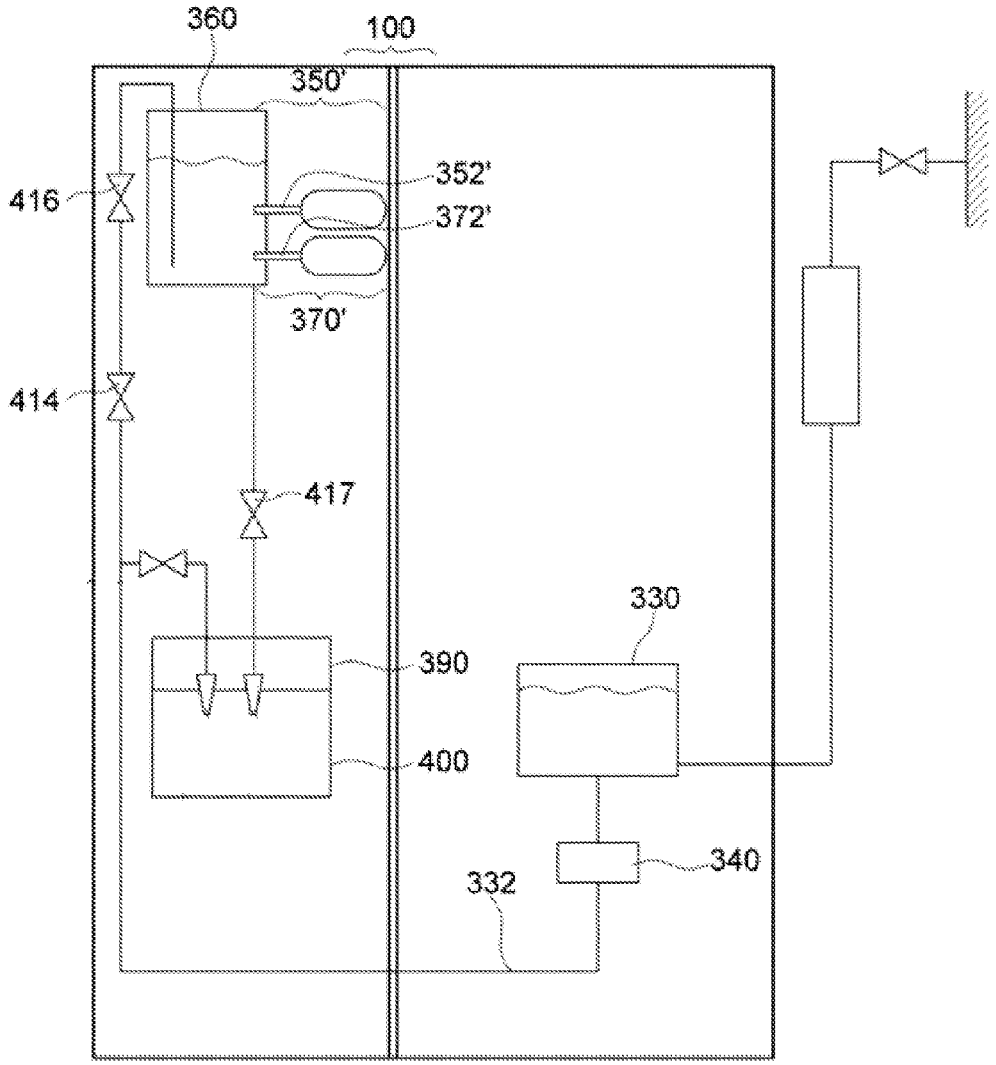
FIG. 6 is a front view of an exemplary refrigerator according to yet another embodiment of the present disclosure.

FIG. 6 is a front view of an exemplary refrigerator according to yet another embodiment of the present disclosure.

According to the example shown in FIG. 5, the refrigerator includes separate dissolution chambers for producing different types of functional beverages. Thus, the number of functional water types is limited by space in the refrigerator.

Accordingly, the refrigerator according to a third exemplary embodiment of the present disclosure described with reference to FIG. 6 may overcome a spatial limitation inside the refrigerator by coupling a plurality of gas supply units (or a plurality of gas supplying units, e.g., including a first gas supplying unit and a second gas supplying unit) to one dissolution chamber.

The refrigerator according to the third exemplary embodiment of the present disclosure includes a water storing chamber 330 for supplying water, a first compressed gas container 350' and a second compressed gas container 370', and a dissolution chamber 360. Other constituent elements denoted by the same reference numerals as those of FIG. 5 serve the same functions, so that detailed descriptions thereof will be omitted.

A controller 500 in FIG. 7 may control the amount of gas solute discharged from a selected compressed gas container to the dissolution chamber 360 by controlling the corresponding discharge valve 352' or 372' (FIG. 6) according to the kind and the concentration of functional water requested by a user.

The storing chamber 330 may be coupled to the dissolution chamber 360 via a water purifying pipe 332 and a valve 416.

Once the functional water made in the dissolution chamber 360 is discharged through a dispenser 400, the water supplying pump 340 is controlled to resupply the water from the storing chamber 330 to the dissolution chamber 360.

The exemplary embodiments disclosed in the present specification have been described with reference to the accompanying drawings. As described above, the exemplary embodiments illustrated in the respective drawings shall not be limitedly construed, and it may be construed that the exemplary embodiments may be combined by those fully understanding the contents of the present specification, and when the exemplary embodiments are combined, some constituent elements may be omitted.

The exemplary embodiments disclosed in the specification of the present disclosure will not limit the present disclosure. The scope of the present disclosure shall be construed on the basis of the following claims, and it shall be construed that all of the technical ideas included within the scope equivalent to the claims belong to the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A refrigerator comprising:

a storing chamber configured to store water;

a first gas supplying unit comprising a first discharge valve for discharging a first gas from a first compressed gas container configured to store the first gas;

a second gas supplying unit including a second discharge valve for discharging a second gas from a second compressed gas container configured to store the second gas; and a dissolution chamber configured to receive water supplied from the storing chamber; wherein gas discharged from the first gas supplying unit and the second gas supplying unit is a solute that is operable to dissolve in the water in the dissolution chamber;

an input unit configured to receive a user selection of a functional beverage and generate a first signal indicating the selection of the functional beverage, and receive a user selection of a concentration level of the functional beverage and generate a second signal indicating a selected concentration level; and a controller configured to: select a corresponding discharge valve from the first discharge valve and the second discharge valve according to the user selection of the functional beverage responsive to the first signal and the second signal; and control corresponding discharge valve based on the selected concentration level responsive to the first signal and the second signal, wherein the solute is one of oxygen gas and carbon dioxide gas, and the functional beverage is one of oxygen water beverage and carbonated water beverage.

2. The refrigerator of claim 1 further comprising:

a dispenser coupled to a water supplying valve for dispensing the functional beverage made in the dissolution chamber; and a water supplying pump configured to supply the water from the storing chamber to the dissolution chamber when the functional beverage is discharged from the dissolution chamber.

3. A method performed by a refrigerator, the method comprising:

receiving, by an input unit of the refrigerator, user input with respect to a choice of functional beverage and a concentration level of the functional beverage;

generating, by the input unit of the refrigerator, a first signal indicating a selected functional beverage and a second signal indicating a selected concentration level;

controlling, by a controller selecting a corresponding discharge valve from a first discharge valve and a second discharge valve responsive to the first signal and the second signal, wherein the first discharge valve is configured to discharge a first gas from a first compressed gas container, and wherein further the second discharge valve is configured to discharge a second gas from a second compressed gas container;

controlling, by a controller, an opening time of the corresponding discharge valve based on the second signal to discharge gas from one of the first compressed gas container and the second compressed gas container to a dissolution chamber containing water; and dispensing the selected functional beverage made by dissolving the gas in the water in the dissolution chamber;

wherein the gas is one of oxygen gas and carbon dioxide gas, and the selected functional beverage is one of oxygen water beverage and carbonated water beverage.

4. The method of claim 3 further comprising:

controlling, by the controller, a water supplying pump disposed between the dissolution chamber and a storing chamber to supply water from the storing chamber to the dissolution chamber, after the selected functional beverage is dispensed from the dissolution chamber.

* * * * *